US005863874A

United States Patent [19]

Person Hei et al.

[11] Patent Number: 5,863,874

[45] **Date of Patent: *Jan. 26, 1999**

[54] ALKYL ETHER AMINE CONVEYOR LUBRICANT

[75] Inventors: Kimberly L. Person Hei, Oakdale; Michael E. Besse, Golden Valley; Bruce E. Schmidt, St. Paul; Christopher S. Sykes, New Brighton; Timothy A. Gutzmann, Eagan, all of Minn.

[73] Assignee: Ecolab Inc., St. Paul, Minn.

[ * ] Notice: The term of this patent shall not extend beyond the expiration date of Pat. No. 5,723,418.

[21] Appl. No.: 926,958

[22] Filed: Sep. 10, 1997

Related U.S. Application Data

[63] Continuation of Ser. No. 658,960, May 31, 1996, abandoned.

[51] Int. Cl.[6] ..... C10M 129/26; C10M 133/04; C10M 173/02

[52] U.S. Cl. ..... 508/521; 508/525; 508/559; 508/562

[58] Field of Search ..... 508/559, 562, 508/525, 511, 527

[56] References Cited

U.S. PATENT DOCUMENTS

| | | | |
|---|---|---|---|
| Re. 30,885 | 3/1982 | Rieder . | |
| 2,758,086 | 8/1956 | Stuart | 508/527 |
| 3,148,747 | 9/1964 | Batchelor . | |
| 3,170,539 | 2/1965 | Snay et al. . | |
| 3,336,225 | 8/1967 | Sayad et al. . | |
| 3,576,234 | 4/1971 | Batchelor . | |
| 3,583,914 | 6/1971 | Garvin et al. . | |
| 3,661,784 | 5/1972 | Bellos . | |
| 3,766,068 | 10/1973 | Tesdahl et al. . | |
| 3,860,521 | 1/1975 | Aepli et al. . | |
| 4,226,325 | 10/1980 | Vandas . | |
| 4,233,176 | 11/1980 | Conner, Sr. . | |
| 4,289,636 | 9/1981 | Davis et al. . | |
| 4,342,596 | 8/1982 | Conner, Sr. . | |
| 4,348,210 | 9/1982 | Sung | 1/1 |
| 4,511,482 | 4/1985 | Horodysky . | |
| 4,552,569 | 11/1985 | Horodysky . | |
| 4,566,879 | 1/1986 | Horodysky . | |
| 4,581,039 | 4/1986 | Horodysky . | |
| 4,589,992 | 5/1986 | Phillips et al. . | |
| 4,613,343 | 9/1986 | Horodysky et al. . | |
| 4,626,367 | 12/1986 | Kuwamoto et al. . | |
| 4,719,084 | 1/1988 | Schmid et al. . | |
| 4,752,405 | 6/1988 | Kyle et al. . | |
| 4,789,493 | 12/1988 | Horodysky . | |
| 4,824,586 | 4/1989 | Johnson et al. . | |
| 4,828,735 | 5/1989 | Minagawa et al. . | |
| 4,828,737 | 5/1989 | Sandberg et al. . | |
| 4,839,067 | 6/1989 | Jansen . | |
| 4,849,119 | 7/1989 | Horodysky . | |
| 4,895,668 | 1/1990 | Singh et al. . | |
| 5,062,978 | 11/1991 | Weber et al. . | |
| 5,073,280 | 12/1991 | Rossio et al. | 508/527 |
| 5,174,914 | 12/1992 | Gutzmann . | |
| 5,182,035 | 1/1993 | Schmidt et al. . | |
| 5,223,162 | 6/1993 | Rossio | 252/33.2 |
| 5,441,654 | 8/1995 | Rossio | 252/49.3 |
| 5,510,045 | 4/1996 | Remus | 252/49.3 |

FOREIGN PATENT DOCUMENTS

| | | | |
|---|---|---|---|
| A-70188/91 | 8/1991 | Australia . | |
| 0 044 458 (A1) | 1/1982 | European Pat. Off. . | |
| 0 233 774 (A3) | 8/1987 | European Pat. Off. . | |
| 0 310 363 (A1) | 4/1989 | European Pat. Off. . | |
| 0 372 628 (A2) | 6/1990 | European Pat. Off. . | |
| 0 384 282 (A1) | 8/1990 | European Pat. Off. . | |
| 0 445 525 (A1) | 9/1991 | European Pat. Off. . | |
| 0 260 508 (A3) | 3/1988 | Germany . | |
| 60 135 492 | of 0000 | Japan . | |
| 90-104332 | of 0000 | Japan . | |
| WO 9417170 | 4/1994 | WIPO . | |
| WO 95/14795 | 6/1995 | WIPO . | |
| WO 95 26389 | 10/1995 | WIPO | 1/1 |

OTHER PUBLICATIONS

"Specifications and properties of DUOMEEN® Diamines and Diamine Salts DUOMAC® Diamine Acetate Sales", *Amak Chemical Bulletin 85–1* pp.1–5 (1985). Month unknown.

S. Block, "Disinfection, Sterilization, and Preservation",Lea & Febiger, pp.228,248–249 (1991).

S. Budavari, et al., "The Merck Index", Merck & Co., Inc., p.323 (1989). Month Unknown.

(List continued on next page.)

*Primary Examiner*—Margaret Medley

*Attorney, Agent, or Firm*—Merchant, Gould, Smith, Edell, Welter & Schmidt, P.A.

[57] ABSTRACT

The invention includes lubricant concentrate and use solution compositions having an amine compound of the formula, $$R_1—O—R_2—NH_2,$$

$$R_1—O—R_2—NH—R_3—NH_2,$$

and mixtures thereof wherein $R_1$ may be a linear saturated or unsaturated $C_6$–$C_{18}$ alkyl, $R_2$ is a linear or branched $C_1$–$C_8$ alkyl, and $R_3$ may be a linear or branched $C_1$–$C_8$ alkyl. The concentrate also comprises an acidulant, optionally a stabilizing hydrotrope, and a surfactant. The lubricant use solution resulting from dilution of the concentrate has an amine compound in a concentration ranging from about 10 ppm to 10000 ppm. Also disclosed is a method of lubricating a conveyor system which includes providing a use solution of the lubricant concentrate composition.

44 Claims, No Drawings

OTHER PUBLICATIONS

B. Davis "Recent Developments in the Technology of Surfactants", *Critial Reports on Applied Chemistry* , vol. 30, pp.65–73 (1990). Month unknown.

G. Denton, "CHLORHEXIDINE", CH 16, pp.274–275. Month unknown.

G. Variotin, "Inhibition and Distruction of the Microbiol. Cell", P.F. D'Arcy. pp.636–639,675 and 685.

Tomah Product Inc. brochure date unknown "Ever Evolving Chemistry . . . Everlasting Quality . . . ", Tomah Products, Inc. 1012 Terra Drive, Milton, WI 55363 Date Unknown.

"Ether Amines" brochure, Tomah Products, Inc., 1012 Terra Drive, Milton, Wisconsin, Mar. 2, 1995.

"Sokalan®DCS", Technical Information, BASF, Apr. 1988.

"Abstracts of Dimer Acid Use—Patents and Journal References", Emery Industries, Inc., Technical Bulletin 412C, Sep., 1971.

ALKYL ETHER AMINE CONVEYOR LUBRICANT

This is a Continuation of application Ser. No. 08/658,960, filed May 31, 1996 now abandoned.

FIELD OF THE INVENTION

The invention relates generally to synthetic conveyor lubricant compositions. More specifically, the invention relates to antimicrobial lubricant compositions providing improved solubility in hard water and diminished reactivity with soils including alkyl ether amine and diamine compounds. The lubricants of the invention are useful with glass, aluminum and beverage containers as well as other articles of manufacture. These lubricants are prepared from an admixture of a linear alkyl ether amine or diamine, surfactant and acid.

BACKGROUND OF THE INVENTION

Beverages and other comestibles are often processed and packaged on mechanized conveyor systems which are lubricated to reduce friction between the packaging and the load bearing surface of the conveyor. In the past, the lubricants commonly used on the load bearing surfaces of these conveyor systems typically contained fatty acid soaps as the active lubricating ingredient.

Moreover, at least in a bottling operation, it is highly desirable that a lubricant be efficacious in lubricating the tracks upon which the various types of containers translate i.e. cans, glass and PET articles. Fatty acid lubricants are efficacious in conjunction with any of these types of containers. Thus, the lubricants disclosed in the above-referred to patents are "universal" lubricants in their application to various beverage containers.

These fatty acid lubricants have in the past provided excellent lubricity. However, fatty acid lubricants are also known to form insoluble precipitates in the presence of calcium and magnesium cations commonly found in hard water. Water softeners and chemical chelating agents such as EDTA must be used with lubricants based on fatty acids to prevent formation of such precipitates. Failure to implement such measures generally results in the formation of a precipitate which may plug the spray nozzles used for applying the lubricant to the conveyor.

Antimicrobial agents are particularly useful for conveyor systems which may transport food substances. Spillage of beverage and other comestibles on the conveyor often results in the growth of bacteria, yeast and mold and may create a slime or soil which, in turn, hampers conveyor performance and may also detract from product purity and appearance. Antimicrobial agents are particularly useful for reducing slime formation in conveyor systems which may transport food substances.

Fatty acid based lubricants have been formulated with effective antimicrobial agents, however, the tendency to react with water hardness ions compromises the overall performance of the lubricant.

Jansen, U.S. Pat. No. 4,839,067 discloses a process for the maintenance of chain-type conveyor belts by treating the conveyor belt with an antimicrobial lubricant composition containing a lubricating amount of a neutralized $C_{12-18}$ primary fatty amine. However, as noted in Jansen, the primary fatty acid amines tend to form a precipitate in the presence of anions such as $SO_4^{-2}$, $PO_4^{-3}$ and $CO_3^{-2}$, commonly found as impurities in water. The precipitate may plug spray nozzles and soil the surfaces of the conveyor system in much the same way as fatty acid soaps in the presence of water hardness.

Schmidt et al., U.S. Pat. No. 5,182,035 discloses aliphatic ether diamine acetates which are used in lubricant compositions in combination with alcoholic hydrotropes used to enhance physical stability.

Weber et al., U.S. Pat. No. 5,062,978 also discloses aqueous lubricant compositions based upon fatty alkyl amines which are useful in conveyor belt operations, especially in the transport of bottles.

Schapira, Published European Patent Application No. 0,533,552 A1 discloses lubricant compositions comprising branched saturated or unsaturated $C_6$ to $C_{21}$ alkyl ether amines and diamines. The lubricant compositions are useful in conveyor operations and may also comprise a surfactant, and alcohol solvent.

Even though primary fatty acid amines have been found to provide adequate lubricity and antimicrobial activity, their usefulness is limited because of the tendency to form precipitates in the presence of those anions commonly found in water.

Accordingly, a substantial need still exists for an antimicrobial conveyor lubricant which provides a combination of superior lubricity, tolerance for both anions and cations commonly found in the water used to dilute the lubricant formulation prior to application to the conveyor system, and non-reactivity in the presence of food spillage such as beer.

SUMMARY OF THE INVENTION

In accordance with a first aspect of the invention, there is provided a lubricant concentrate composition having an effective lubricating amount of amine compound of the formula, $$R_1—O—R_2—NH_2,$$

$$R_1—O—R_2—NH—R_3—NH_2,$$

and mixtures thereof wherein $R_1$ may be a linear saturated or unsaturated $C_6$–$C_{18}$ alkyl, $R_2$ may be a linear or branched $C_{1-8}$ alkyl, and $R_3$ may be a linear or branched $C_1$–$C_8$ alkyl. The concentrate generally may also contain a surfactant in an amount effective to provide detergency to the concentrate upon dilution and use, and an acid in an amount effective to solubilize the amine. Optionally, the concentrate may also comprise a hydrotrope for product stability.

The invention also includes a lubricant use solution resulting from dilution of this concentrate, with the amine compound present in a concentration ranging from about 10 ppm to 10000 ppm.

In accordance with another aspect of the invention there is provided a method of lubricating a conveyor system with a use solution of the lubricant concentrate composition of the invention.

The invention is a lubricant comprised of linear alkyl ether amines. The linear alkyl ether amine lubricants of the invention promote lubricity and solubility in aqueous systems in the presence of ions and beverage soil, and remain in solution over a wide pH range. The lubricants of the invention remain stable and substantially unreacted with free anions and food soil present in the system. Furthermore, the linear alkyl ether amines of the invention negate the need for alcohol type solvents to maintain physical stability of the concentrate.

The invention provides reduced soiling of conveyors resulting from the diminished interaction of food soil with the lubricant. Compositions of the invention also provide greater lubricant tolerance to ion laden water.

The claimed invention also provides good gliding action at low dilution rates for polyethylene terephthalate (PET), glass, and metal surfaces. Further, the lubricants of the invention also provide antimicrobial efficacy on non-food contact surfaces providing a bacterial reduction of 99.9% within five minutes.

DETAILED DESCRIPTION OF THE PREFERRED EMBODIMENT

The invention is a lubricant concentrate composition, use solution, and method of use. The concentrate may be a solid or liquid. The compositions of the invention include linear alkyl ether amine compounds which provide lubricity, antimicrobial character, as well as a reduction in the formation of various precipitates which often occur in the environment of use. Compositions of the invention may also include an acid source, detergency agents, and optional hydrotrope stabilizers among other constituents. The invention also includes methods of using the claimed invention.

A. The Linear Alkyl Ether Amine Compounds

The lubricant of the invention comprises an amine compound. The amine compound functions to enhance compositional lubricity, further antimicrobial character, and reduce or eliminate the formation of various precipitates resulting from the dilution of water and/or contaminants on the surface of application.

The amine compounds of the invention may comprise any number of species. Preferably, the amine compound is an alkyl ether amine compound of the formula,

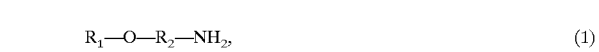

$$R_1—O—R_2—NH_2, \quad (1)$$

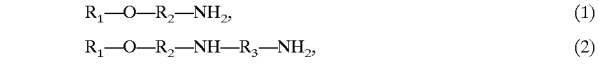

$$R_1—O—R_2—NH—R_3—NH_2, \quad (2)$$

and mixtures thereof wherein $R_1$ may be a linear saturated or unsaturated $C_6$–$C_{18}$ alkyl, $R_2$ may be a linear or branched $C_{1-8}$ alkyl, and $R_3$ may be a linear or branched $C_1$–$C_8$ alkyl.

More preferably, $R_1$ is a linear $C_{12}$–$C_{16}$ alkyl; $R_2$ is a $C_2$–$C_6$ linear or branched alkyl; and $R_3$ is a $C_2$–$C_6$ linear or branched alkyl.

Preferred compositions of the invention include linear alkyl ether diamine compounds of formula (2) wherein $R_1$ is $C_{12}$–$C_{16}$, $R_2$ is $C_3$, and $R_3$ is $C_3$.

When the amine compound used is an amine of formulas (1) and (2), $R_1$ is either a linear alkyl $C_{12}$–$C_{16}$ or a mixture of linear alkyl $C_{10}$–$C_{12}$ and $C_{14}$–$C_{16}$.

Overall the linear alkyl ether amine compounds used in the composition of the invention provide lower use concentrations, upon dilution, with enhanced lubricity. The amount of the amine compound in the concentrate generally ranges from about 0.1 wt-% to 90 wt-%, preferably about 0.25 wt-% to 75 wt-%, and more preferably about 0.5 wt-% to 50 wt-%. These materials are commercially available from Tomah Products Incorporated as PA-19, PA-1618, PA-1816, DA-18, DA-19, DA-1618, DA-1816, and the like.

The use dilution of the concentrate is preferably calculated to get disinfectant or sanitizing efficacy in the intended application or use. Accordingly, the active amine compound concentration in the composition of the invention ranges from about 10 ppm to 10000 ppm, preferably from about 20 ppm to 7500 ppm, and most preferably about 40 ppm to 5000 ppm.

B. Neutralizing Agent

The concentrate and use dilution compositions of the invention also preferably comprise an acid source. The acid source is effective in solubilizing the amine compound. Generally, any acid source may be used which provides an effective pH of between about 5 and 10 in the concentrate and lubricant use solution.

Exemplary acids include organic and inorganic acids. Inorganic acids useful in the composition of the invention include hydrochloric acid, phosphoric acid, hydrofluoric acid, sulfuric acid, nitric acid, hydrobromic acid, and sulfamic acid, among others.

Organic acids useful in the invention include acetic acid, ascorbic acid, isoascorbic acid, hydroxyacetic acid, gluconic acid, lactic acid, benzoic acid, $C_8$–$C_{20}$ saturated and unsaturated fatty acids, such as oleic acid, and mixtures thereof.

Preferably, the neutralizing agent is an organic acid and most preferably acetic acid, formic acid, gluconic acid and mixtures thereof.

The concentration of acid should be adequate and effective to fully solubilize and stabilize the various constituents and the concentrate and use dilution compositions of the invention. Preferably the pH of the use-solution lubricant ranges from about 5 to 10, and more preferably about 5.5 to 9.5.

C. Surfactants

The lubricant compositions of the invention optionally, but preferably, may further include a surfactant. The surfactant functions as an adjuvant to increase detergency and lubricity. Compounds which may be used as surfactants in the invention include, nonionic surfactants, amphoteric surfactants, anionic surfactants, and cationic surfactants among other compounds.

Anionic surfactants are generally those compounds containing a hydrophobic hydrocarbon moiety and a negatively charged hydrophilic moiety. Typical commercially available products provide either a carboxylate, sulfonate, sulfate or phosphate group as the negatively charged hydrophilic moiety. Broadly, any of the commercially available anionic surfactants may be usefully employed in the lubricant composition of the invention.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include specifically, but not exclusively, ethoxylated alkylphenols, ethoxylated aliphatic alcohols, ethoxylated amines, ethoxylated ether amines, carboxylic esters, carboxylic amides, and polyoxyalkylene oxide block copolymers.

Particularly suitable nonionic surfactants for use in the lubricant composition of the invention are the alkoxylated (preferably ethoxylated) alcohols having the general formula $R^{10}O((CH_2)_mO)_n$ wherein $R^{10}$ is an aliphatic group having from about 8 to about 24 carbon atoms, m is a whole number from 1 to about 5, and n is a number from 1 to about 40 which represents the average number of ethylene oxide groups on the molecule.

Cationic surfactants are also useful in the invention and may also function as an additional antimicrobial. Typical examples include quaternary ammonium chloride surfactants such as n-alkyl ($C_{12-18}$) dimethyl benzyl ammonium chloride, n-alkyl ($C_{14-18}$) dimethyl benzyl ammonium chloride, n-tetradecyl dimethyl benzyl ammonium chloride monohydrate, n-alkyl ($C_{12-14}$) dimethyl 1-naphthylmethyl ammonium chloride.

Amphoteric surfactants, surfactants containing both an acidic and a basic hydrophilic group, can be used in the invention. Amphoteric surfactants can contain the anionic or cationic group common in anionic or cationic surfactants and additionally can contain either hydroxyl or other hydrophilic groups that enhance surfactant properties. Such amphoteric surfactants include betaine surfactants, sulfobetaine surfactants, amphoteric imidazolinium derivatives and others.

Generally, in the concentrate, the surfactant concentration ranges from about 0.01 wt-% to 50 wt-%, and preferably from about 0.1 wt-% to 20 wt-%. More preferably the surfactant concentration ranges from about 1 to 10 wt-% and the surfactant is a nonionic alcohol ethoxylate such as Neodol 25-7 from Shell Chemical.

D. Hydrotrope

The lubricant composition of the invention may optionally include an effective amount of a hydrotrope for viscosity control and cold temperature stability of the concentrate. In this context, stability includes maintaining the phase stability of the concentrate and use-dilution compositions by maintaining a homogenous mixture.

A variety of compatible hydrotropes are available for use in the lubricant composition including monofunctional and polyfunctional alcohols as well glycol and glycol ether compounds. Those which have been found most useful include alkyl alcohols such as, for example, ethanol, isopropanol, and the like. Polyfunctional organic alcohols include glycerol, hexylene glycol, polyethylene glycol, propylene glycol, sorbitol and the like.

The preferred hydrotropes are di-functional alcohols such as alkyl glycols. One compound which has found heightened efficacy in stabilization of the concentrate and its use solution is hexylene glycol.

Preferably, the concentration of hydrotrope ranges from about 0.1 to 40 wt-%, and more preferably about 1 to 25 wt-% in the concentrate. In one preferred mode the hydrotrope is present in a concentration of about 3 wt-% to 10 wt-% and comprises hexylene glycol.

WORKING EXAMPLES

The following Working Examples illustrate various properties, characteristics and exemplary embodiments of the invention. However, these examples are not intended to be limiting of the claimed invention.

Working Example 1

Measurement of Gliding Action

As can be seen in Table 1, samples for lubricity measure were diluted to 0.1 wt-% active amine compound with distilled water containing 200 ppm $NaHCO_3$ and streamed along the perimeter of a polished stainless steel plate measuring 20.5 cm in diameter. The plate was connected to an electric motor, and rotated at an even rate when switched on. A glass disk weighing 189 gm or a mild steel disk weighing 228 gm was attached to a load cell and placed on the plate in the area wetted by the lubricant solution. When the electric motor was switched on, the disk glided freely on the plate. The drag between the glass or mild steel disk and the stainless steel plate was detected by the load cell, and transferred to a chart recorder.

To assure consistency of the test method, the drag from a standard fatty acid lubricant solution was measured before and after each trial run, and the value obtained therefrom arbitrarily assigned a coefficient of friction of 1.00. Each trial run was referenced to the fatty acid lubricant trials, thus the results are reported as a relative coefficient of friction (COF). The lower the COF, the better the lubricity.

The formulation used as a control was a fatty acid lubricant comprising:

| Raw Material | % |
|---|---|
| Soft Water | 54.70 |
| Hydrotrope | 2.00 |
| Sodium Xylene Sulfonate | 1.60 |
| Tetradodium EDTA liquid | 10.20 |
| TEA, 85% | 13.50 |
| Nonionic Surf. | 8.00 |
| Fatty Acid | 10.00 |
| Total | 100.00 |

and the COF for this composition was:

| | Relative Coefficient of Friction | |
|---|---|---|
| Formula[1] | Glass on Stainless | Mild Steel on Stainless |
| Fatty Acid Control | 1.00 | 1.00 |

[1]Formula was tested at 0.1% wt in distilled water containing 200 ppm added $NaHCO_3$.

In turn the lubricity for the various amine compounds is shown in Table 1 below.

TABLE 1

Gliding Action of Amines in Aqueous Solutions

| Solution[2] | Amine Type | wt-% | R-Group | Relative Coefficient of Friction[1] Glass on Stainless | Mild Steel on Stainless |
|---|---|---|---|---|---|
| A[3] | tetradecyloxpropyl-1,3-diamino propane | 10 | linear | 0.95 | 1.16 |
| B[3] | $C_{12}/C_{14}$ alkoxy propyl amine | 10 | linear | 0.80 | 1.12 |
| C[4] | isodecyloxypropyl-1, | 10 | branched | 1.25 | 1.91 |

TABLE 1-continued

Gliding Action of Amines in Aqueous Solutions

| Solution[2] | Amine Type | wt- % | R-Group | Relative Coefficient of Friction[1] Glass on Stainless | Mild Steel on Stainless |
|---|---|---|---|---|---|
| | 3-diamino propane | | | | |
| D[4] | isodecyloxypropyl amine | 10 | branched | 1.19 | 1.86 |
| E[4] | isotridecyloxypropyl amine | 10 | branched | 1.37 | 1.45 |
| F | N-oleyl-1,3-diamino propane | 10 | linear | 0.99 | 1.16 |
| G | N-coco-1,3-diamino propane | 10 | linear | 1.07 | 1.17 |

[1]Solutions were tested at 0.1 wt % of the amines.
[2]Amines were combined with acetic acid and soft water to yield 10 wt %- amine solutions of pH 6.
[3]Amine representative of the current invention.
[4]Branched alkyl ether (di)amines as directed by Schapira (European Patent Publication No. 0533 522 A1).

TABLE 2

Gliding Action of Amine-Based Lubricants

| Composition | | | | Relative Coefficient of Friction | |
|---|---|---|---|---|---|
| Formula[1] | Amine Type | % | R-Group | Glass on Stainless | Mild Steel on Stainless |
| H[2] | tetradecyloxypropyl-1,3 diamino propane | 6.0 | linear | 0.91 | 1.38 |
| I[2] | tetradecyloxypropyl-1,3 diamino propane | 8.5 | linear | 0.92 | 1.17 |
| J[2] | tetradecyloxypropyl-1,3 diamino propane | 6.0 | linear | 0.92 | 1.26 |
| | $C_{12}/C_{15}$ alkyloxypropyl amine | 1.5 | linear | | |
| K[2] | tetradecyloxypropyl-1,3 diamino propane | 8.5 | linear | 0.97 | 1.13 |
| | $C_{12}/C_{15}$ alkyloxypropyl amine | 1.5 | linear | | |
| L[3] | isotridecyloxypropyl-1,3-diamino propane | 6.0 | branched | 1.16 | 1.85 |
| | isodecyloxypropyl-1,3 diamino propane | 2.5 | branched | | |
| M[3] | isotridecyloxypropyl-1,3-diamino propane | 6.0 | branched | 1.16 | 1.89 |
| | octyl/decyloxypropyl amine | 1.5 | branched | | |
| N[3] | isotridecyloxypropyl-1,3-diamino propane | 6.0 | branched | 1.17 | 1.84 |
| | isotridecyloxypropyl amine | 1.5 | branched | | |
| O[2] | $C_{12}/C_{15}$ alkyloxypropyl amine | 7.5 | linear | 0.76 | 1.16 |
| P[3] | isotridecyloxypropyl amine | 7.5 | branched | 0.95 | 1.30 |
| Q[3] | isododecyloxypropyl amine | 7.5 | branched | 0.94 | 1.28 |
| R[3] | isodecyloxypropyl amine | 7.5 | branched | 0.96 | 1.28 |
| S | N-oleyl-1,3-diamino propane | 6.0 | linear | 0.94 | 1.31 |
| | N-coco-1,3 diamino propane | 2.5 | linear | | |
| | oleylamine | 1.5 | linear | | |
| T | isotridecyloxypropyl-1,3-diamino propane | 6.0 | branched | 1.24 | 1.83 |
| | oleic fatty acid | 1.5 | linear | | |

[1]Lubricant concentrates were formulated with the specific quantity of amine, 10.0% hydrotrope, 6.8% acetic acid, 10.0% nonionic surfactant, 9.5% KOH (45%), and the remainder soft water.
[2]Formulas representative of the current invention.
[3]Lubricants based on the technology taught by Schapira (EPA No. 0533 522 A1).

As can be seen in the tables above, the linear species provide enhanced lubricity when compared to branched alkyl ether diamine, on interfaces encountered in food and beverage processing plants.

Working Example 2

Testing Procedure for Concentrate Stability

Lubricant samples were prepared according to the current invention and the control with alcohol or glycol-type solvents added at various levels as a stabilizing hydrotrope. Samples were warmed to 49° C. and stirred continuously for 30 minutes, after which time formula stability was assessed visually.

TABLE 3

Concentrate Stability with Hydrotropes at Various Levels

| Base Formula | Hydrotrope | % | Concentrate Stability |
|---|---|---|---|
| U[1] | — | 0.0 | OK |
| V[2] | — | 0.0 | undissolved solids |
| U[1] | propylene glycol | 2.5 | OK |
| V[2] | propylene glycol | 2.5 | undissolved solids |
| U[1] | propylene glycol | 5.0 | OK |
| V[2] | propylene glycol | 5.0 | undissolved solids |
| U[1] | hexylene glycol | 2.5 | OK |
| V[2] | hexylene glycol | 2.5 | undissolved solids |
| U[1] | hexylene glycol | 5.0 | OK |

TABLE 3-continued

Concentrate Stability with Hydrotropes at Various Levels

| Base Formula | Hydrotrope | % | Concentrate Stability |
|---|---|---|---|
| V[2] | hexylene glycol | 5.0 | undissolved solids |
| U[1] | isopropanol | 2.5 | OK |
| V[2] | isopropanol | 2.5 | undissolved solids |
| U[1] | isopropanol | 5.0 | OK |
| V[2] | isopropanol | 5.0 | OK |

[1]Lubricant incorporating linear alkyl ether diamines, formulated as follows: designated hydrotrope with 2.5% acetic acid, 10.0% $C_{12}/C_{14}$ alkyloxypropyl-1,3-diamino propane, 10.0% nonionic surfactant, and the remainder soft water.
[2]Lubricant incorporating designated hydrotrope with 2.5% acetic acid, 6.6% N-oleyl-1,3-diamino propane, 3.4% N-coco-1,3-diamino propane, 10.0% nonionic surfactant, and the remainder soft water.

The linear alkyl ether (di)amines, do not require a hydrotrope for concentrate stability as can be seen by these results.

Working Example 3

Test Procedure for Use Solution Clarity at Various pHs

Lubricant samples representing the current invention and controls were formulated according to the compositions in the Table 4 below. One percent solutions were prepared using the challenge water diluent (below), and the solution pH adjusted to 5–10 with dilute acetic acid or KOH. Clouding behavior was determined after 15 minutes.

Preparation of Challenge Water

The procedure used to test clouding behavior of lubricant solutions was that disclosed by Weber, U.S. Pat. No. 5,062,978. In each solution, 500 ppm $Na_2SO_4$ and 500 ppm NaCl were added to softened water, and this anion-laden water was used as the lubricant diluent.

The linear alkyl ether (di)amines show a tolerance for anions as indicated by the results shown above.

Working Example 4

Beer Challenge Testing Procedure

An evaluation of lubricant clarity was conducted on an amine acetate based lubricant. The lubricant contained:

| Constituent | wt-% |
|---|---|
| Distilled $H_2O$ | 62.25 |
| Hexylene Glycol | 10.00 |
| Tomah DA-18 | 10.00 |
| Acetic Acid, Glacial | 4.25 |
| Deriphat 160C | 5.00 |
| Quaternary Ammonium Surfactant | 6.00 |
| KOH 45% | 2.50 |
| | 100.00 |

TOMAH DA-18 is tetradecyl oxypropyl-1, 3-diamino propane

Using a sample of lubricant neutralized to a pH of approximately 7, the lubricant was mixed with beer to determine solution clarity. The solution comprised 0.25 wt-% lubricant in a 50:50 beer water solution. The results showed:

Initial—clear

Day 1—clear

Day 7—clear, no precipitate

To further determine the lubricant reactivity with beverage soil likely encountered in a brewery, the lubricant compositions in Table 5 were diluted to 1% with distilled water and the resultant solutions combined with equal parts of a commercially available lager beer. Beer/lubricant solution clarity was observed after five minutes and four hours.

TABLE 4

Solution Clarity at pH 5–10 in Anion-Laden Soft Water

| Compositions[2] | | | 1% Solution Clarity in Challenge[1] Water pH[3] | | | | | |
|---|---|---|---|---|---|---|---|---|
| Formula | Amine Type | % | 5 | 6 | 7 | 8 | 9 | 10 |
| W[4] | tetradecyloxypropyl-1,3 diamino propane | 8 | clear | clear | clear | clear | clear | cloudy |
| X | N-oleyl-1,3-diarnino propane | 8 | hazy/opaque | hazy/opaque | cloudy | cloudy | cloudy | cloudy |
| Z[4] | $C_{12}/C_{14}$ alkyloxypropyl-1,3 diamino propane | 8 | clear | clear | clear | clear | clear | cloudy |
| AA | N-oleyl-1,3-diamino propare | 4 | clear | clcar | clear | cloudy | cloudy | cloudy |
| | N-coco-1,3-diamino propane | 4 | | | | | | |
| CC[4] | $C_{12}/C_{14}$ alkyloxypropyl-1,3 diamino propane | 6 | clear | clear | clear | clear | clear | cloudy |
| | $C_{12}/C_{15}$ alkyloxypropyl amine | 2 | | | | | | |
| DD | N-oleyl-1,3-diamino propane | 4 | cloudy | clear | clear | cloudy | cloudy | cloudy |
| | N-coco-1,3-diamino propane | 2 | | | | | | |
| | oleylamine | 2 | | | | | | |

[1]Challenge water prepared by adding 500 ppm $Na_2SO_4$ and 500 ppm NaCl to softened water.
[2]Composition of all formulas: 8.0% total amines, 10.0% hydrotrope, 1.8% acetic acid, 10.0% nonionic linear alcohol ethoxylate surfactant, and 70.2% soft water.
[3]1% lubricant solutions adjusted to pH 5, 6, 7, 8, 9 or 10 with dilute acetic acid or KOH.
[4]Compositions W, Z and CC are formulated with linear alkyl ether (di)amines in accordance with this invention.

TABLE 5

Lubricant Solution Clarity in Beer Challenge Test[4]

| Compositions[1] | | | Solution Clarity in Presence of Beer[2] | |
|---|---|---|---|---|
| Formula | Amine Type | % | Five Minutes | Four Hours |
| W[3] | tetradecyloxypropyl-1, 3 diamino propane | 8 | clear | cloudy |
| X | N-oleyl-1, 3-diamino propane | 8 | hazy/ opaque | opaque with particles |
| Z[3] | $C_{12}/C_{14}$ alkyloxypropyl-1, 3 diamino propane | 8 | clear | clear |
| AA | N-oleyl-1, 3-diamino propane | 4 | cloudy | cloudy |
| | N-coco-1, 3-diamino propane | 4 | | |
| CC[3] | $C_{12}/C_{14}$ alkyloxypropyl-1, 3 diamino propane | 6 | clear | clear |
| | $C_{12}/C_{15}$ alkyloxypropyl amine | 2 | | |
| DD | N-oleyl-1, 3-diamino propane | 4 | cloudy | cloudy |
| | N-coco-1, 3-diamino propane | 2 | | |
| | oleylamine | 2 | | |

[1]Composition of all formulas: 8.0% total amines, 10.0% hydrotrope, 1.8% acetic acid, 10.0% nonionic surfactant, and 70.2% soft water.
[2]Commercially available lager-type beer.
[3]Compositions W, Z and CC are formulated with linear alkyl ether (di)amines in accordance with this invention.
[4]After dilution, the pH for all samples ranged from 4 to 5.

Formulas W, Z and CC employing linear alkyl ether (di)amines showed nonreactivity with typical beverage soil. In contrast, beer interacted more readily with the lubricants of Formulas X and AA.

Working Example 5

Testing of Antimicrobial Properties

Aqueous lubricant solutions having 0.25 or 0.50 wt % concentration of the linear alkyl ether amine formula were prepared with synthetic hard water (sterile distilled water containing 40 ppm each $MgCl_2$ and $CaCl_2$). One ml of the inoculum, prepared as set forth below was combined with 99 mls of the lubricant solution and swirled. A one ml sample of the lubricant solution/inoculum mixture was removed after a one minute exposure time and added to 9 mls of a sterile Letheen broth as a neutralizer. The pH of the samples ranged from 6.5 to 7.0. The neutralized sample was serially diluted with buffered water and plated in duplicate using tryptone glucose extract (TGE) agar. The procedure was repeated after five, 15 and 60 minute exposure times. The plates were incubated at 37° F. for 72 hours.

Controls to determine initial inoculum were prepared by adding one ml of inoculum to 99 mls of buffered water, serially diluting the mixture with additional buffered water, and plating with TGE.

Bacterial Inoculum

The bacteria listed below were transferred and maintained on nutrient agar slants. Twenty-four hours prior to testing, 10 mls of nutrient broth was inoculated with a loopful of each organism, one tube per organism. The inoculated nutrient broth cultures were incubated at 37° C. Shortly before testing, equal volumes of both incubated broth cultures were mixed and used as the test inoculum.

Organisms

*Staphylococcus aureus* ATCC 6538
*Enterobacter aerogenes* ATCC 13048

TABLE 6

Rate of Kill Testing for Linear Alkyl Ether Diamine Lubricant

| | Rate of Kill Results | |
|---|---|---|
| Test Concentration | Exposure Time | % Reduction |
| 0.25% Lubricant[1] | 1.0 minute | >99.999 |
| | 5.0 minutes | >99.999 |
| | 15.0 minutes | >99.999 |
| | 60.0 minutes | >99.999 |
| 0.50% Lubricant[1] | 1.0 minute | >99.999 |
| | 5.0 minutes | >99.999 |
| | 15.0 minutes | >99.999 |
| | 60.0 minutes | >99.999 |

[1]Lubricant comprised of 9.0% $C_{12}/C_{14}$ alkyloxypropyl-1, 3-diamino propane, 7.0% hydrotrope, 4.0% acidulant, 7.0% nonionic surfactant, and the remainder soft water.
pH = 6.5 – 7.0

The alkyl ether amine formula at 0.25 and 0.5 wt % in synthetic hard- water was found to reduce the population of tested organisms by >99.999% within one minute of exposure. This constitutes superior antimicrobial activity.

Working Example 6

PET Compatibility Testing

Polyethylene Terephthalate (or PET) compatibility testing was carried out according to "Method A" in the *Engineering Bulletin* dated July 1994 as supplied by Johnson Controls. Specifically, 2 liter one-piece PET bottles were charged to 4.8–4.9 volumes of $CO_2$ and allowed to dry overnight. On the following day, lubricant concentrate was combined with distilled water at 0.25, 0.75 or 1.5 wt %, and whipped into a foam with an electric mixer. The foam was spread in a lined container and the bases of the bottles were swirled in the foam and left to stand in the container for 14 days in an environmental chamber set at 90% humidity and 37° C. A successful test result is one in which none of the bottles burst or leak within the 14 day time frame.

TABLE 7

PET Compatibility Testing

| | Number of Bottles | |
|---|---|---|
| Lubricant[1] Concentration | Tested | Passing |
| 0.25% | 12 | 12 |
| 0.75% | 12 | 12 |
| 1.50% | 12 | 12 |

[1]Lubricant comprised of 6.0% tetradecyloxypropyl-1, 3-diamino propane, 2.5% isodecyloxypropyl-1, 3-diamino propane, 10.0% hexylene glycol, 6.8% acidulant, 10.0% nonionic surfactant, 9.5% KOH (45%), and the remainder soft water.

The above specification, examples and data provide a complete description of the manufacture and use of the composition of the invention. Since many embodiments of the invention can be made without departing from the spirit and scope of the invention, the invention resides in the claims hereinafter appended.

We claim as our invention:

1. A lubricant concentrate composition comprising:

a. an effective lubricating amount of one or more amine compounds, each of said compounds having a formula selected from the group consisting of, $R_1—O—R_2—NH_2$, $R_1—O—R_2—NH—R_3—NH_2$, and mixtures thereof wherein $R_1$ is a group selected from the alkyls consisting of a linear $C_{12-16}$ alkyl, and a mixture of linear $C_{14-16}$ alkyl and linear $C_{10-12}$ alkyl, $R_2$ is a linear or branched $C_1$–$C_8$ alkylene, and $R_3$ is a linear or branched $C_1$–$C_8$ alkylene group;

b. an amount of acidulant effective to provide a pH of about 5 to 10; and c. an amount of surfactant effective to provide detergency to the composition upon dilution and use, said surfactant selected from the group consisting of anionic surfactant, a cationic surfactant, an amphoteric surfactant, a nonionic surfactant, and mixtures thereof.

2. The concentrate of claim 1 wherein said amine compound is present in a concentration of about 0.1 wt-% to 90 wt-%.

3. The concentrate of claim 1, wherein said amine compound is a monoamine compound, $R_1$ is a linear $C_{12}$–$C_{16}$ alkyl group, and $R_2$ is a $C_2$–$C_6$ alkylene group.

4. The concentrate of claim 1, wherein said concentrate comprises more than one amine compound, at least one of said amine compounds is a monoamine compound, $R_1$ is selected from the group consisting of a $C_{12}$–$C_{16}$ alkyl group, and a mixture of a $C_{10}$–$C_{12}$ alkyl group and a $C_{14}$–$C_{16}$ alkyl group; and $R_2$ if a $C_2$–$C_6$ alkylene group.

5. The concentrate of claim 1, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

6. The concentrate of claim 1 wherein said concentrate comprises more than one amine compound, at least one of said amine compounds is a diamine compound, each $R_1$ is selected from the group consisting of a $C_{12}$–$C_{16}$ alkyl group, and a mixture of a $C_{10}$–$C_{12}$ alkyl group, and a $C_{14}$–$C_{16}$ alkyl group; $R_2$ is a $C_2$–$C_6$ alkylene group, and $R_3$ is a $C_2$–$C_6$ alkylene.

7. The concentrate of claim 1 additionally comprises a hydrotrope.

8. The concentrate of claim 7 wherein said hydrotrope is selected from the group consisting of glycols, alcohols, glycol ethers, and mixtures thereof.

9. The concentrate of claim 7 wherein said hydrotrope comprises hexylene glycol, present in a concentration of from about 0.1 wt-% to 40 wt-%.

10. The concentrate of claim 9 wherein said surfactant comprises a nonionic surfactant present in a concentration of from about 0.01 wt-% to 50 wt-%.

11. The concentrate of claim 1 wherein said amine compound comprises a linear tetradecyl oxypropyl-1,3-diamino propane, said composition additionally comprising hexylene glycol hydrotrope each of said amine compound and hydrotrope present in a concentration ranging from about 8 wt-% to 12 wt-%.

12. The concentrate of claim 1, wherein said composition is a solid.

13. The concentrate of claim 1, wherein said composition is a liquid.

14. The concentrate of claim 1, wherein said acidulant is an organic acid.

15. The concentrate of claim 14, wherein said organic acid is selected from the group consisting of acetic acid, hydroxyacetic acid, gluconic acid, lactic acid, benzoic acid, formic acid, and mixtures thereof.

16. The concentrate of claim 1, wherein the acidulant is selected from the group consisting of acetic acid, formic acid, gluconic acid, and mixtures thereof.

17. The concentrate of claim 1, wherein said concentrate has sanitizing antimicrobial efficacy.

18. An aqueous lubricant composition comprising a major portion of aqueous diluent, from about 10 ppm to 10000 ppm of one or more amine compounds, each of said amine compounds having a formula selected from the group consisting of $R_1—O—R_2—NH_2$, $R_1—O—R_2—NH—R_3—NH_2$, and mixtures thereof wherein $R_1$ is a group selected from the alkyls consisting of a linear $C_{12-16}$ alkyl, and a mixture of linear $C_{14-16}$ alkyl and linear $C_{10}$–$C_{12}$ alkyl, $R_2$ is a linear or branched $C_1$–$C_8$ alkylene, and $R_3$ is a linear or branched $C_1$–$C_8$ alkylene group, an amount of surfactant effective to provide detergency upon use, said surfactant selected from the group consisting of an anionic surfactant, a cationic surfactant, a nonionic surfactant, an amphoteric surfactant, and mixtures thereof; and an amount of acid effective to provide a pH of from about 5 to 10.

19. The lubricant of claim 18 wherein said amine compound is present in a concentration of about 0.001 wt-% to 1.0 wt-%.

20. The lubricant of claim 18, wherein said amine compound is a monoamine compound, $R_1$ is a $C_{12}$–$C_{16}$ alkyl group, and $R_2$ is a $C_2$–$C_6$ alkylene group.

21. The lubricant of claim 18, wherein said lubricant comprises more than one amine compound, at least one of said amine compounds is a monoamine compound, $R_1$ is selected from the group consisting of a $C_{12}$–$C_{16}$ alkyl group, and a mixture of a $C_{10}$–$C_{12}$ alkyl group and a $C_{14}$–$C_{16}$ alkyl group; and $R_2$ is a $C_2$–$C_6$ alkylene group.

22. The lubricant of claim 18, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

23. The lubricant of claim 18, wherein said lubricant comprises more than one amine compound, at least one of said amine compounds is a diamine compound, $R_1$ is selected from the group consisting of a $C_{12}$–$C_{16}$ alkyl group, and a mixture of a $C_{10}$–$C_{12}$ alkyl group and a $C_{14}$–$C_{16}$ alkyl group, and mixtures thereof; $R_2$ is a $C_2$–$C_6$ alkylene group; and $R_3$ is a $C_2$–$C_6$ alkylene group.

24. The lubricant of claim 18, additionally comprises a hydrotrope.

25. The lubricant of claim 24, wherein said hydrotrope is selected from the group consisting of glycols, alcohols, glycol ethers and mixtures thereof.

26. The lubricant of claim 24, wherein said hydrotrope comprises hexylene glycol present in a concentration of from about 0.001 wt-% to 1 wt-%.

27. The lubricant of claim 18, wherein said surfactant comprises a nonionic surfactant present in a concentration of from about 0.0005 wt-% to 1 wt-%.

28. The lubricant of claim 27, wherein said nonionic surfactant has from about 1 to 40 moles of ethoxylation.

29. The lubricant of claim 18, wherein said lubricant solution has sanitizing antimicrobial efficacy.

30. A method of lubricating a conveyor system using an aqueous lubricant composition comprising an effective lubricating amount of one or more amine compounds each of said amine compounds having a formula selected from the group consisting of, $R_1—O—R_2—NH_2$, $R_1—O—R_2—NH—R_3—NH_2$, and mixtures thereof wherein $R_1$ is a group selected from the alkyls consisting of a linear $C_{12-16}$ alkyl, and a mixture of linear $C_{14-16}$ alkyl and linear $C_{10}$–$C_{12}$ alkyl, $R_2$ is a linear or branched $C_1$–$C_8$ alkylene, and $R_3$ is a linear or branched $C_1$–$C_8$ alkylene, an amount of surfactant effective to provide detergency to the concentrate upon dilution and use, said surfactant selected from the group consisting of an anionic surfactant, a cationic surfactant, an amphoteric surfactant, a nonionic surfactant, a mixtures thereof; and amount of acid to provide pH of about 5 to 10 upon dilution and use, said method comprising the steps of:

(a) formulating the lubricant concentrate composition to have from about 0.1 wt-% to 90 wt-% of said amine compound;

(b) diluting said lubricant concentrate with water to form a lubricant; and (c) applying said lubricant to the intended surface of use.

31. The method of claim 30, wherein said amine compound is a monoamine compound, $R_1$ is a $C_{12}$–$C_{16}$ alkyl group, and $R_2$ is a $C_2$–$C_6$ alkylene group.

32. The method of claim 30, wherein said lubricant comprises more than one amine compound and at least one of said amine compounds is a monoamine compound, $R_1$ is selected from the group consisting of a $C_{12}$–$C_{16}$ alkyl group, and a mixture of a $C_{10}$–$C_{12}$ alkyl group, and a $C_{14}$–$C_{16}$ alkyl group; and $R_2$ is a $C_2$–$C_6$ alkylene group.

33. The method of claim 30, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

34. The method of claim 30, wherein said lubricant comprises more than one amine compound and at least one of said amine compounds is a diamine compound, $R_1$ is selected from the group consisting of a $C_{12}$–$C_{16}$ alkyl group, and a mixture of a $C_{10}$–$C_{12}$ alkyl group and a $C_{14}$–$C_{16}$ alkyl group; $R_2$ is a $C_2$–$C_6$ alkylene group; and $R_3$ is a $C_2$–$C_6$ alkylene group.

35. The method of claim 30 wherein said solution is formulated to additionally comprise a hydrotrope.

36. The method of claim 35, wherein said hydrotrope is selected from the group consisting of glycols, alcohols, glycol ethers, and mixtures thereof.

37. The method of claim 35, wherein said hydrotrope comprises hexylene glycol present in a concentration of from about 0.1 wt-% to 40 wt-%.

38. The method of claim 30, wherein said surfactant comprises a nonionic surfactant present in a concentration of from about 0.01 wt-% to 50 wt-%.

39. The method of claim 30, wherein said lubricant composition acid is selected from the group consisting of acetic acid, hydroxy acetic acid, gluconic acid, lactic acid, benzoic acid, formic acid, and mixtures thereof.

40. The method of claim 30, wherein said lubricant use solution provides a sanitizing level of antimicrobial efficacy to the intended surface of use.

41. The method of claim 30, wherein said lubricant use solution is compatible with polyethylene terephthalate.

42. The lubricant of claim 18, wherein said acidulant is an organic acid.

43. The lubricant of claim 42, wherein said organic acid is selected from the group consisting of acetic acid, hydroxyacetic acid, gluconic acid, lactic acid, benzoic acid, formic acid, and mixtures thereof.

44. The lubricant of claim 18, wherein the acidulant is selected from the group consisting of acetic acid, formic acid, gluconic acid, and mixtures thereof.

* * * * *

UNITED STATES PATENT AND TRADEMARK OFFICE

CERTIFICATE OF CORRECTION

PATENT NO. : 5,863,874
DATED : January 26, 1999
INVENTOR(S) : Person Hei et al.

It is certified that error appears in the above-identified patent and that said Letters Patent is hereby corrected as shown below:

Column 13,
Line 5, delete the words "mixtures thereof"; and insert -- linear $C_{10-12}$ alkyl -- after the word "and"

Column 14,
Line 16, delete the words "mixtures thereof"
Line 16, insert -- linear $C_{10}$-$C_{12}$ alkyl -- after the word "and"
Line 32, delete "is a monoamine compound"
Line 32, insert -- , -- after the word "compound"
Line 48, delete "alkyl" after the formula "$C_{10}$-$C_{12}$"
Line 49, delete "mixtures thereof"
Line 49, insert -- ; -- after the word "group"

Column 15,
Line 7, delete "mixtures thereof"
Line 7, insert -- linear $C_{10}$-$C_{12}$ alkyl -- after the word "and"

Signed and Sealed this

Twenty-fifth Day of June, 2002

*Attest:*

*Attesting Officer*

JAMES E. ROGAN
*Director of the United States Patent and Trademark Office*